US005828024A

United States Patent [19]

Takano et al.

[11] Patent Number: 5,828,024

[45] Date of Patent: Oct. 27, 1998

[54] SWITCH

[75] Inventors: Tsunesuke Takano; Kouichi Sinzawa; Yoji Yabata, all of Tokyo, Japan

[73] Assignee: Kabushiki Kaisha T an T, Tokyo, Japan

[21] Appl. No.: 777,345

[22] Filed: Dec. 27, 1996

[30] Foreign Application Priority Data

Oct. 29, 1996 [JP] Japan ..... 8-286530

[51] Int. Cl.[6] ..... H01H 13/12

[52] U.S. Cl. ..... 200/531; 200/284; 200/530

[58] Field of Search ..... 200/284, 341, 200/530, 531, 536; 439/109

[56] References Cited

U.S. PATENT DOCUMENTS

| | | | |
|---|---|---|---|
| 2,293,606 | 8/1942 | Kimbell | 200/284 |
| 2,304,808 | 12/1942 | Draving | 200/284 |
| 2,798,128 | 7/1957 | Ford | 200/284 |
| 4,296,990 | 10/1981 | Stowers et al. | 439/109 |
| 5,145,059 | 9/1992 | Park | 200/284 |

*Primary Examiner*—David J. Walczak

*Attorney, Agent, or Firm*—Nixon & Vanderhye PC

[57] ABSTRACT

A switch includes a resilient contact plate that slides by operating an operating lever such as a pushing lever protruding from a housing. Terminal plates over which the resilient contact plate slides are attached so that the ends protrude into recesses formed in the bottom of the housing. Contact and, contact terminals fit into the recesses of the housing have resilient clamps that resiliently clamp the ends of the terminal plates extending into the recesses and blade terminals of bus bars rising from an insulated base.

14 Claims, 4 Drawing Sheets

SWITCH

BACKGROUND OF THE INVENTION

1. Field of the Invention

The present invention relates to a switch that incorporates resilient clamps for directly connecting with the blade terminals of bus bars in the housing of a switch such as a push-button switch.

2. Description of the Prior Art

In the past, in order to connect a switch with a circuit on an insulated base, the switch and circuit were connected by inserting the female connector of a lead wire, of which one end was soldered to the circuit on the insulated base, onto a lead plate of a switch attached to an attached body such as a panel. In the switch connecting structure of the prior art as described above, the number of work processes was large due to having a process in which the switch is mounted to the attached body, and a process in which the female connector connected with the lead of said switch is soldered to an insulated base by means of a lead wire. This resulted in the problems of requiring additional time for assembly as well as contributing to increased labor costs.

SUMMARY OF THE INVENTION

In order to solve the above-mentioned problems, the object of the present invention is to provide a switch connecting structure that is able to shorten work time and lower labor costs by enabling a switch to be directly attached to a bus bar formed on an insulated base.

In order for the switch connecting structure of the present invention to achieve the above-mentioned object, a switch comprising is provided including resilient contact plate that slides by operating an operating lever such as a pushing lever protruding from a housing; terminal plates over which the resilient contact plate slides that are attached so that the ends protrude into recesses formed in the bottom of the housing; and contact terminals that fit into the recesses of the housing having resilient clamps that resiliently clamp the ends of the terminal plates extending into the recesses and blade terminals of bus bars rising from an insulated base.

The connection terminals are fixed within the recesses of the housing by forming holes in the inside wall of the recesses of the housing and engaging tabs on the flat portions of the connection terminals within the holes. The connection terminals are fixed within the recesses of the housing by forming projections on the inside wall of the recesses of the housing and engaging the projections in holes in the flat portions of the contact terminals.

DESCRIPTION OF THE PREFERRED EMBODIMENT

The following provides an explanation of the form of one embodiment of the switch in the present invention with reference to FIG. 1 through FIG. 4.

Figure 1:
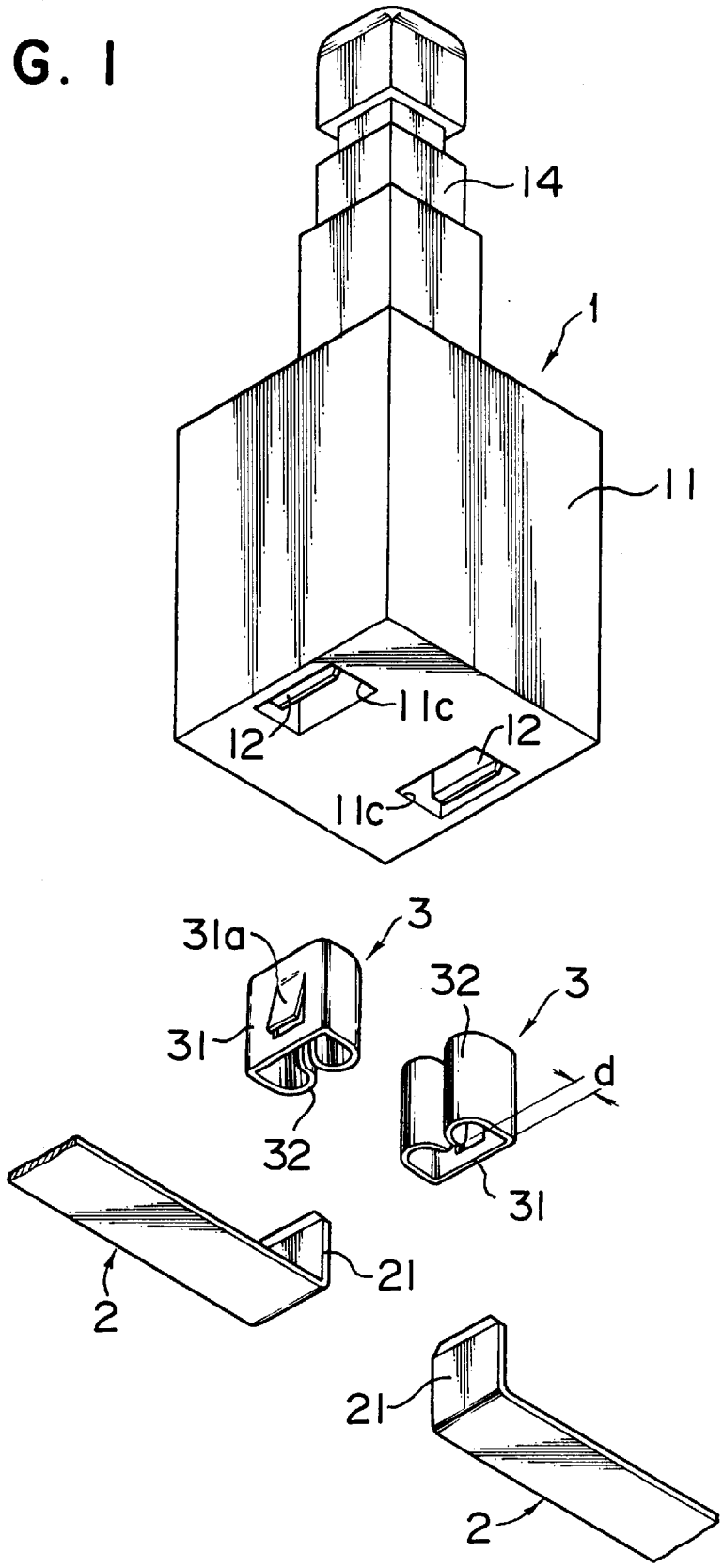
FIG. 1 is an exploded perspective view showing a first embodiment in the switch connecting structure of the present invention.
Figure 2:
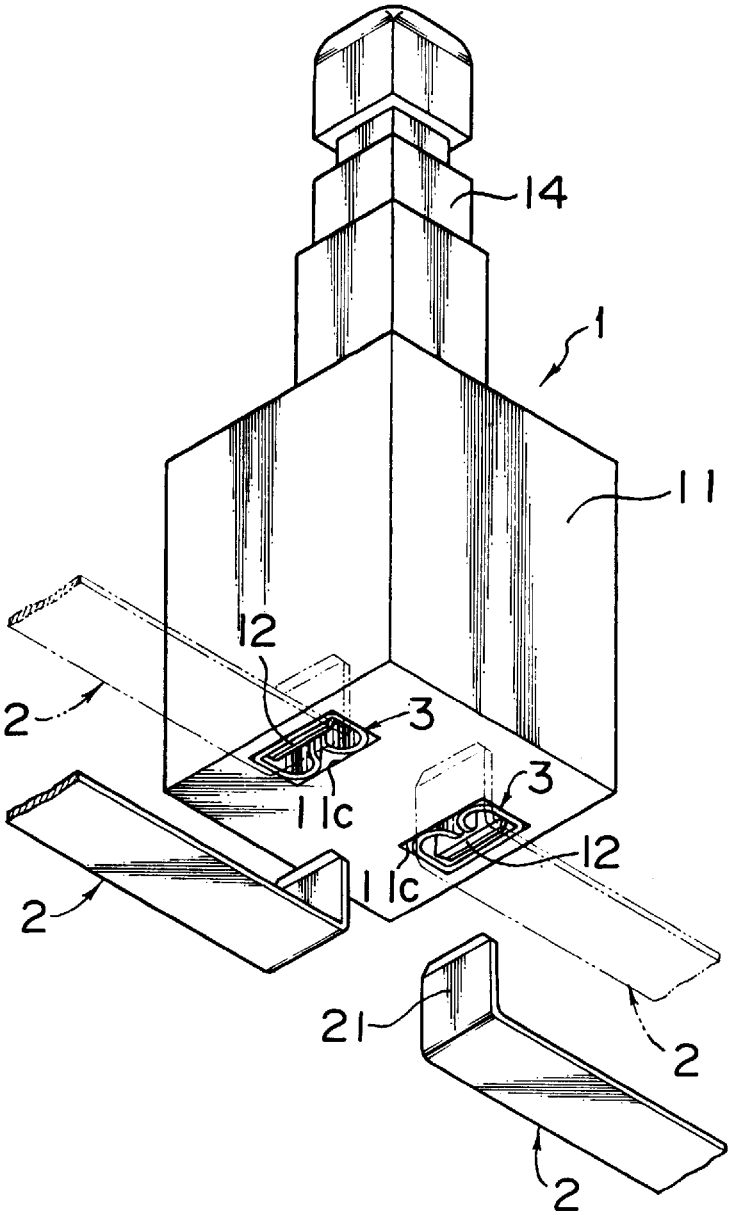
FIG. 2 is a perspective view of the assembled state of the above.
Figure 3:
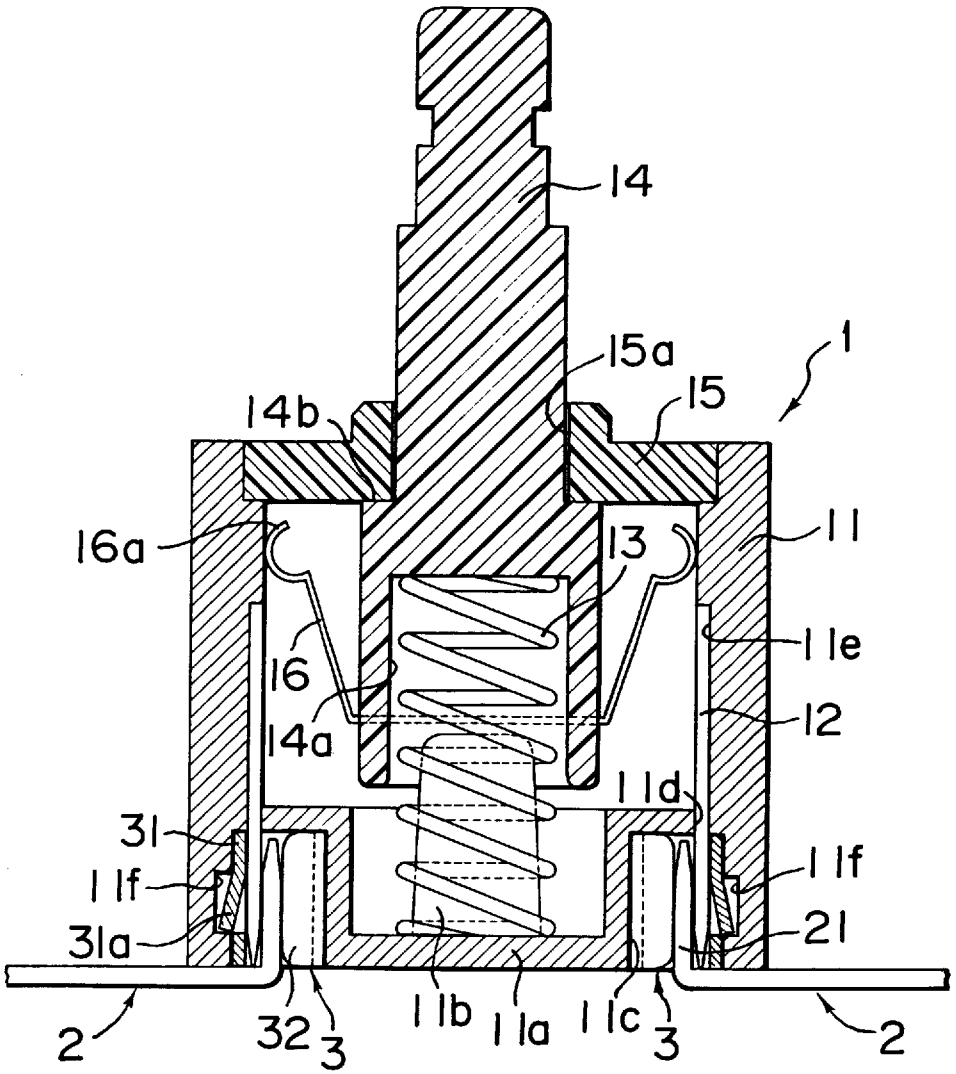
FIG. 3 is a cross-sectional view of the switch in the off state.
Figure 4:
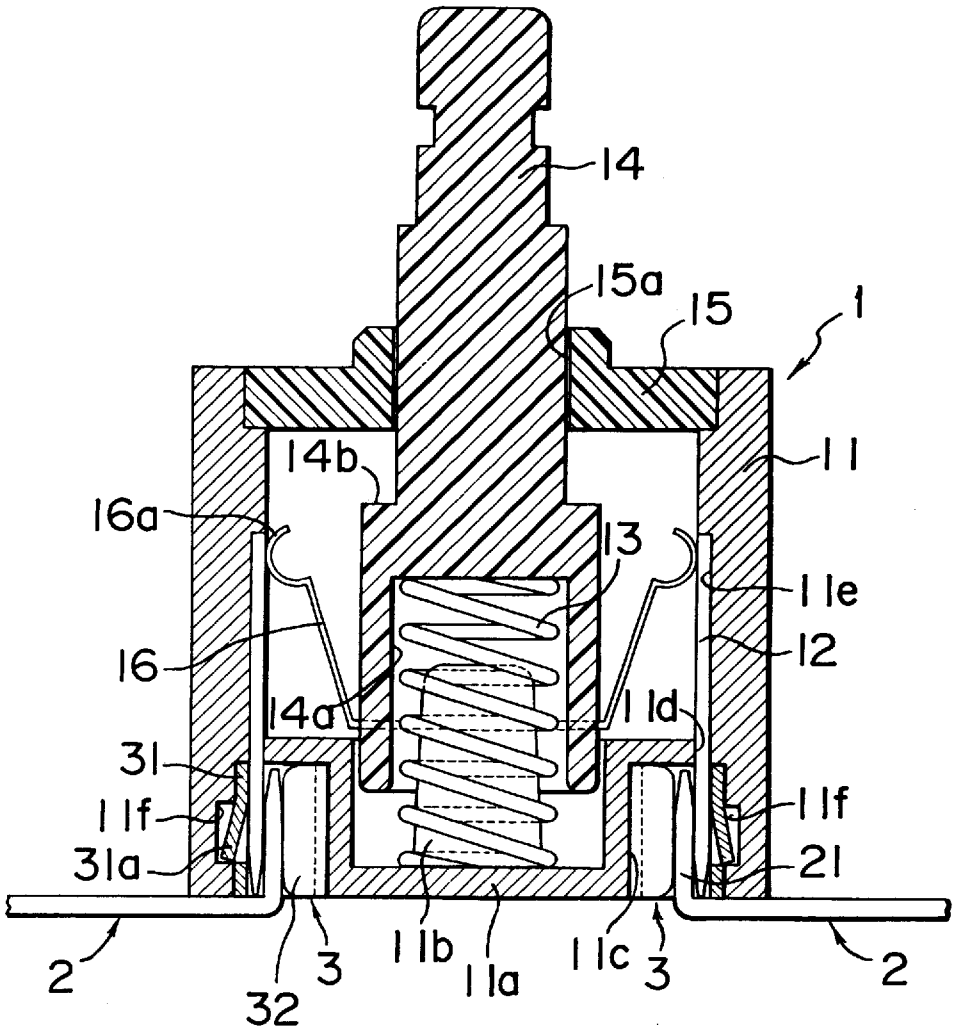
FIG. 4 is a perspective view of the switch in the on state.

In the drawings, reference numeral 1 indicates a switch such as a push-button switch, seesaw switch or slide switch, and as shown in FIGS. 3 and 4, indicates a push-button switch in this embodiment. Furthermore, this push-button switch 1 is used, for example, as a switch for turning on and off the interior lamp unit installed on the roof of an automobile interior.

The following provides a detailed explanation of switch 1. Reference numeral 11 indicates a bottom housing. A projection 11*b* projects toward the inside from the center of bottom 11*a*, and together with mutually facing insertion holes 11*c* being formed, slots 11*d* are formed in each recess 11*c*.

Reference numeral 12 indicates a pair of terminal plates that are press fit into grooves 11*e* formed in the inside wall of housing 11 from the above-mentioned holes 11*d*, the ends of which extend into the above-mentioned recesses. Reference numeral 13 indicates a spring of which one end is inserted onto the above-mentioned projection 11*b*. Reference numeral 14 indicates a pushing lever in which the other end of spring 13 is inserted into hole 14*a*, and protrudes from through hole 15*a* of cover plate 15 fixed on the open end of housing 11. Reference numeral 16 is a resilient contact plate bent roughly into the shape of the letter "U" that is attached to the above-mentioned pushing lever 14, both ends of which have contacts 16*a* formed into a curved shape.

Next, the following provides an explanation of the operation of the above-mentioned switch 1. In FIG. 3, pushing lever 14 is pushed up by the spring force of spring 13 and is stopped as a result of ledge 14*b* of pushing lever 14 making contact with cover plate 15. Thus, since contacts 16*a* of resilient contact plate 16 are positioned away from terminal plates 12 in this state, the space between the pair of terminal plates 12 is electrically off.

In the above-mentioned state, when pushing lever 14 is pushed down in opposition to the spring force of spring 13, contact plate 16 lowers as shown in FIG. 4 causing contacts 16*a* to make contact with terminal plates 12. Consequently, the space between the pair of terminal plates 12 is electrically on. If this type of switch 1 was to be installed, for example, on the chassis of an automobile with the door closed, switch 1 would enter the on state when the door was opened.

Furthermore, although the switch shown in the drawings only enters the on state when pushing lever 14 is pushed, it can be made into a locking push-button switch by incorporating a known locking mechanism. If this type of locking push-button switch 1 was to be used as, for example, a switch for turning on and off the interior lamp unit installed on the roof of an automobile interior, it could be used to turn the interior lamp on and off. Next, the following provides an explanation of a means of installing the above-mentioned switch 1 on an automobile chassis. Reference numeral 2 indicates a pair of bus bars fixed in an insulated state in a chassis (not shown) such as the interior lamp unit, and electrically connected to a lamp, the ends of which are bent at right angles to form blade terminals 21. Reference numeral 3 indicates connection terminals that connect terminal plates 12 and the above-mentioned blade terminals 21 in the above-mentioned switch. Each connection terminal 3 is formed to compose a flat portion 31, eyeglass-shaped resilient clamp 32 that is bent towards the inside into a curved shape on the right and left sides, and tab 31*a* that is formed towards the outside from the above-mentioned flat portion 31.

Furthermore, gaps d between the ends of resilient clamps 32 and flat portions 31 are made to be slightly wider than the thickness between the above-mentioned terminal plates 12 and blade terminals 21 so that clamps 32 are able to resiliently clamp the terminal plates 12 and blade terminals 21 when inserted. In addition, connection terminals 3 are made of a size that enables them to fit inside the above-mentioned recesses 11*c* of housing 11.

Then connection terminals 3 composed in the manner described above are fit into the above-mentioned recesses 11*c* of housing 11, tabs 31*a* formed in flat portions 31 are fixed in place as a result of engaging with depressions 11*f* formed in recesses 11*c*. In addition, when connection terminals 3 are fit into recesses 11*c*, terminal plates 12 are inserted between flat portions 31 and resilient clamps 32.

Furthermore, fixing of connection terminals 3 in recesses 11*c* is not only performed by engaging the above-mentioned tabs 31*a* with depressions 11*f*, but may also be performed by forming holes in flat portions 31, forming projections in recesses 11*c*, and engaging these projections in the holes of flat portions 31. Moreover, this fixing may also be performed by press fitting. Next, the following provides an explanation of the method by which switch 1 is attached to blade terminals 21 of bus bars 2. When depressions 11*c* are inserted onto blade terminals 21 rising from an interior lamp unit and so forth (and the interval between the pair of blade terminals 21 is roughly equal to the interval between recesses 11*c* of housing 11), blade terminals 21 resiliently fit between terminal plates 12 and resilient clamps 32. Thus, blade terminals 21 and terminal plates 12 are fixed in a contact state.

When pushing lever 14 in switch 1 is pressed down in this state, the pair of bus bars 2 are electrically connected. In addition, when the pushing force on pushing lever 14 is released, the space between the pair of bus bars 2 becomes electrically open.

EFFECTS OF THE INVENTION

As has been described above, since the present invention extends the ends of terminal plates, over which a resilient contact plate slides by the operation of an operating lever such as a pushing lever protruding from a housing, into recesses formed in the housing, connection terminals are fit into the recesses so that the ends of the terminal plates are resiliently clamped by resilient clamps, and the blade terminals of bus bars are inserted into the resilient clamps of these connection terminals, since the blade terminals are resiliently clamped with said terminal plates, connection of the switch and the bus bars can be performed without the use of a connecting means such as welding, thus simplifying the work process since the work time required for connecting the two components is shortened and the two components can be disconnected easily.

We claim:

1. A switch comprising:

a housing having terminal plate recesses and connection terminal recesses;

an operating lever protruding from said housing, said operating lever sliding between an OFF state and an ON state;

a resilient contact plate coupled with said operating lever;

terminal plates disposed in said terminal plate recesses of said housing, said housing defining a contact path for said resilient contact plate, said terminal plates being disposed in said terminal plate recesses along a portion of said contact path; and connection terminals disposed in said connection terminal recesses of said housing, said connection terminals resiliently clamping ends of said terminal plates in said housing, said connection terminals being shaped to receive blade terminals of bus bars from an insulated base, wherein said resilient contact plate is displaced along said contact path when said operating lever slides between said OFF state and said ON state, and wherein said resilient contact plate engages said terminal plates in said ON state.

2. A switch as set forth in claim 1, wherein said connection terminals are fixed within said connection terminal recesses of said housing by forming one of holes and projections in an inside wall of said connection terminal recesses and engaging a corresponding one of tabs and holes of said connection terminals with said holes and projections, respectively.

3. A switch as set forth in claim 1, wherein said connection terminals are shaped to sandwich said blade terminals of said bus bars and said terminal plates.

4. A switch as set forth in claim 1, wherein said contact path is linear.

5. A switch as set forth in claim 1, wherein in said OFF state, said resilient contact plate is engaged with said housing.

6. A switch as set forth in claim 1, further comprising a spring disposed between said operating lever and said housing, said spring biasing said operating lever toward said OFF state.

7. A switch comprising:

a housing having terminal plate recesses and connection terminal recesses;

a movable operating lever protruding from said housing;

a resilient contact plate coupled with said movable operating lever, said resilient contact plate sliding linearly between an OFF state and an ON state with said movable operating lever;

terminal plates disposed in said terminal plate recesses of said housing, said housing defining a contact path for said resilient contact plate, said terminal plates being disposed in said terminal plate recesses along a portion of said contact path; and connection terminals disposed in said connection terminal recesses of said housing, said connection terminals resiliently clamping ends of said terminal plates in said housing, said connection terminals being shaped to receive blade terminals of bus bars from an insulated base, wherein said resilient contact plate is displaced along said contact path when said operating lever slides between said OFF state and said ON state, and wherein said resilient contact plate engages said terminal plates in said ON state.

8. A switch as set forth in claim 7, wherein said connection terminals are fixed within said connection terminal recesses of said housing by forming one of holes and projections in an inside wall of said connection terminal recesses and engaging a corresponding one of tabs and holds of said connection terminals with said holes and projections, respectively.

9. A switch as set forth in claim 7, wherein said connection terminals are shaped to sandwich said blade terminals of said bus bars and said connection terminals.

10. A switch as set forth in claim 7, wherein said contact path is linear.

11. A switch as set forth in claim 7, wherein in said OFF state, said resilient contact plate is engaged with said housing.

12. A switch as set forth in claim 7, further comprising a spring disposed between said operating lever and said housing, said spring biasing said operating lever toward said OFF state.

13. A switch unit coupled with blade terminals of bus bars of an insulated base, the switch unit comprising:

a housing having terminal plate recesses and connection terminal recesses;

an operating lever protruding from said housing, said operating lever sliding between an OFF state and an ON state;

a resilient contact plate coupled with said operating lever;

terminal plates disposed in said terminal plate recesses of said housing, said housing defining a contact path for said resilient contact plate, said terminal plates being disposed in said terminal plate recesses along a portion of said contact path; and connection terminals disposed in said connection terminal recesses of said housing, said connection terminals resiliently clamping ends of said terminal plates in said housing, said connection terminals receiving the blade terminals, wherein said resilient contact plate is displaced along said contact path when said operating lever slides between said OFF state and said ON state, and wherein said resilient contact plate engages said terminal plates in said ON state.

14. A switch unit as set forth in claim 13, wherein said connection terminals sandwich said blade terminals and said terminal plates.

* * * * *